US006112346A

United States Patent [19]

Agadzi

[11] Patent Number: 6,112,346

[45] Date of Patent: Sep. 5, 2000

[54] GURNEY-WHEELCHAIR

[76] Inventor: Victor Y. Agadzi, 9385 SW. 77th Ave. #4027, Miami, Fla. 33156

[21] Appl. No.: 09/267,007

[22] Filed: Mar. 11, 1999

[51] Int. Cl.[7] ..... A61G 7/16

[52] U.S. Cl. ..... 5/86.1; 5/87.1; 5/83.1

[58] Field of Search ..... 5/81.1 R, 83.1, 5/85.1, 86.1, 87.1, 89.1

[56] References Cited

U.S. PATENT DOCUMENTS

| | | | |
|---|---|---|---|
| 616,282 | 12/1898 | Allen | 5/89 |
| 2,480,314 | 8/1949 | Benedict | 5/89.1 |
| 2,673,987 | 4/1954 | Upshaw et al. | 5/86.1 |
| 2,975,434 | 3/1961 | Butler et al. | 5/86.1 |
| 3,015,114 | 1/1962 | Seib | 5/86.1 |
| 3,131,404 | 5/1964 | Bowers et al. | 5/86.1 |
| 3,469,269 | 9/1969 | Brown | 5/86.1 |
| 5,177,822 | 1/1993 | Kassai | 5/85.1 X |

*Primary Examiner*—Michael F. Trettel

[57] ABSTRACT

A gurney-wheelchair for transferring a patient from one bed structure or chair to another bed structure or chair. The gurney-wheelchair includes a generally inverted U-shaped cross bar with an upper portion and a spaced apart pair of arm portions downwardly depending from the upper portion of the cross bar. Each of the arm portions of the cross bar has a pair of opposite elongate side bars outwardly extending therefrom. The inner ends of the side bars are pivotally coupled to the associated arm portion of the cross bar. The side bars of a first of the arm portions each have a support wedge pivotally mounted thereto and capable of folding upwards vertically. The side bars of a second of the arm portions each have a support wedge pivotally mounted thereto and capable of folding upwards vertically. Each of the support wedges of the first and second arm portions has a pair of mounting arms slidably extended through the associated side bar of the second arm portion. The lower end of the first arm portion is coupled to a ground engaging base structure.

15 Claims, 3 Drawing Sheets

13
33
49
41
45
52
47
51
46
45
52
42
47
44
48
50
43
52
48

GURNEY-WHEELCHAIR

BACKGROUND OF THE INVENTION

1. Field of the Invention

The present invention relates to systems for transferring a patient from one bed structure or chair to another bed structure or chair and more particularly pertains to a new gurney-wheelchair for transferring a patient from one bed structure or chair to another bed structure or chair.

2. Description of the Prior Art

The use of systems for transferring a patient from one bed structure or chair to another bed structure or chair is known in the prior art. More specifically, systems for transferring a patient from one bed structure or chair to another bed structure or chair heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,459,891; U.S. Pat. No. 5,117,516; U.S. Pat. No. 5,560,054; U.S. Pat. No. 3,451,070; U.S. Pat. No. 3,371,357; and U.S. Pat. No. Des. 285,137.

While these devices fulfill their respective, particular objectives and requirements, the aforementioned patents do not disclose a new gurney-wheelchair. The inventive device includes a generally inverted U-shaped cross bar with an upper portion and a spaced apart pair of arm portions downwardly depending from the upper portion of the cross bar. Each of the arm portions of the cross bar has a pair of opposite elongate side bars outwardly extending therefrom. The inner ends of the side bars are pivotally coupled to the associated arm portion of the cross bar. The side bars of a first of the arm portions each have a support wedge pivotally mounted thereto, and capable of folding up vertically. The side bars of a second of the arm portions each have a support wedge pivotally mounted thereto and capable of folding up vertically. Each of the support wedges of the second arm portion has a pair of mounting arms slidably extended through the associated side bar of the first and second arm portions. The lower end of the first arm portion is coupled to a ground engaging base structure.

In these respects, the gurney-wheelchair according to the present invention substantially departs from the conventional concepts and designs of the prior art, and in so doing provides an apparatus primarily developed for the purpose of transferring a patient from one bed structure or chair to another bed structure or chair.

SUMMARY OF THE INVENTION

In view of the foregoing disadvantages inherent in the known types of systems for transferring a patient from one bed structure or chair to another bed structure or chair now present in the prior art, the present invention provides a new transformable gurney-wheelchair construction wherein the same can be utilized for transferring a patient from one bed structure or chair to another bed structure or chair.

The general purpose of the present invention, which will be described subsequently in greater detail, is to provide a new gurney-wheelchair apparatus and method which has many of the advantages of the systems for transferring a patient from one bed structure or chair to another bed structure or chair mentioned heretofore and many novel features that result in a new gurney-wheelchair which is not anticipated, rendered obvious, suggested, or even implied by any of the prior art systems for transferring a patient from one bed structure or chair to another bed structure or chair, either alone or in any combination thereof.

To attain this, the present invention generally comprises a generally inverted U-shaped cross bar with an upper portion and a spaced apart pair of arm portions downwardly depending from the upper portion of the cross bar. Each of the arm portions of the cross bar has a pair of opposite elongate side bars outwardly extending therefrom. The inner ends of the side bars are pivotally coupled to the associated arm portion of the cross bar. The side bars of a first of the arm portions each have a support wedge pivotally mounted thereto and capable of folding up vertically. The side bars of a second of the arm portions each have a support wedge pivotally mounted thereto and capable of folding up vertically. Each of the support wedges of the first and second arm portions has a pair of mounting arms slidably extended through the associated side bar of the second arm portion. The lower end of the first arm portion is coupled to a ground engaging base structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gurney-wheelchair apparatus and method which has many of the advantages of the systems for transferring a patient from one bed structure or chair to another bed structure or chair mentioned heretofore and many novel features that result in a new gurney-wheelchair which is not anticipated, rendered obvious, suggested, or even implied by any of the prior art systems for transferring a patient from one bed structure or chair to another bed structure or chair, either alone or in any combination thereof.

It is another object of the present invention to provide a new gurney-wheelchair which may be easily and efficiently manufactured and marketed.

It is a further object of the present invention to provide a new gurney-wheelchair which is of a durable and reliable construction.

An even further object of the present invention is to provide a new gurney-wheelchair which is susceptible of a low cost of manufacture with regard to both materials and labor, and which accordingly is then susceptible of low prices of sale to the consuming public, thereby making such gurney-wheelchair economically available to the buying public.

Still yet another object of the present invention is to provide a new gurney-wheelchair which provides in the apparatuses and methods of the prior art some of the advantages thereof, while simultaneously overcoming some of the disadvantages normally associated therewith.

Still another object of the present invention is to provide a new gurney-wheelchair for transferring a patient from one bed structure or chair to another bed structure or chair.

Yet another object of the present invention is to provide a new gurney-wheelchair which includes a generally inverted U-shaped cross bar with an upper portion and a spaced apart pair of arm portions downwardly depending from the upper portion of the cross bar. Each of the arm portions of the cross bar has a pair of opposite elongate side bars outwardly extending therefrom. The inner ends of the side bars are pivotally coupled to the associated arm portion of the cross bar. The side bars of a first of the arm portions each have a support wedge pivotally mounted thereto and capable of folding upwards vertically. The side bars of a second of the arm portions each have a support wedge pivotally mounted thereto and capable of folding upwards vertically. Each of the support wedges of the first and second arm portions has a pair of mounting arms slidably extended through the associated side bar of the second arm portion. The lower end of the first arm portion is coupled to a ground engaging base structure.

Still yet another object of the present invention is to provide a new gurney-wheelchair that lets health care providers move an unconscious or invalid patient from an operating table to a bed.

Even still another object of the present invention is to provide a new gurney-wheelchair that requires fewer health care providers to transfer a patient from one bed structure or chair to another bed structure or chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
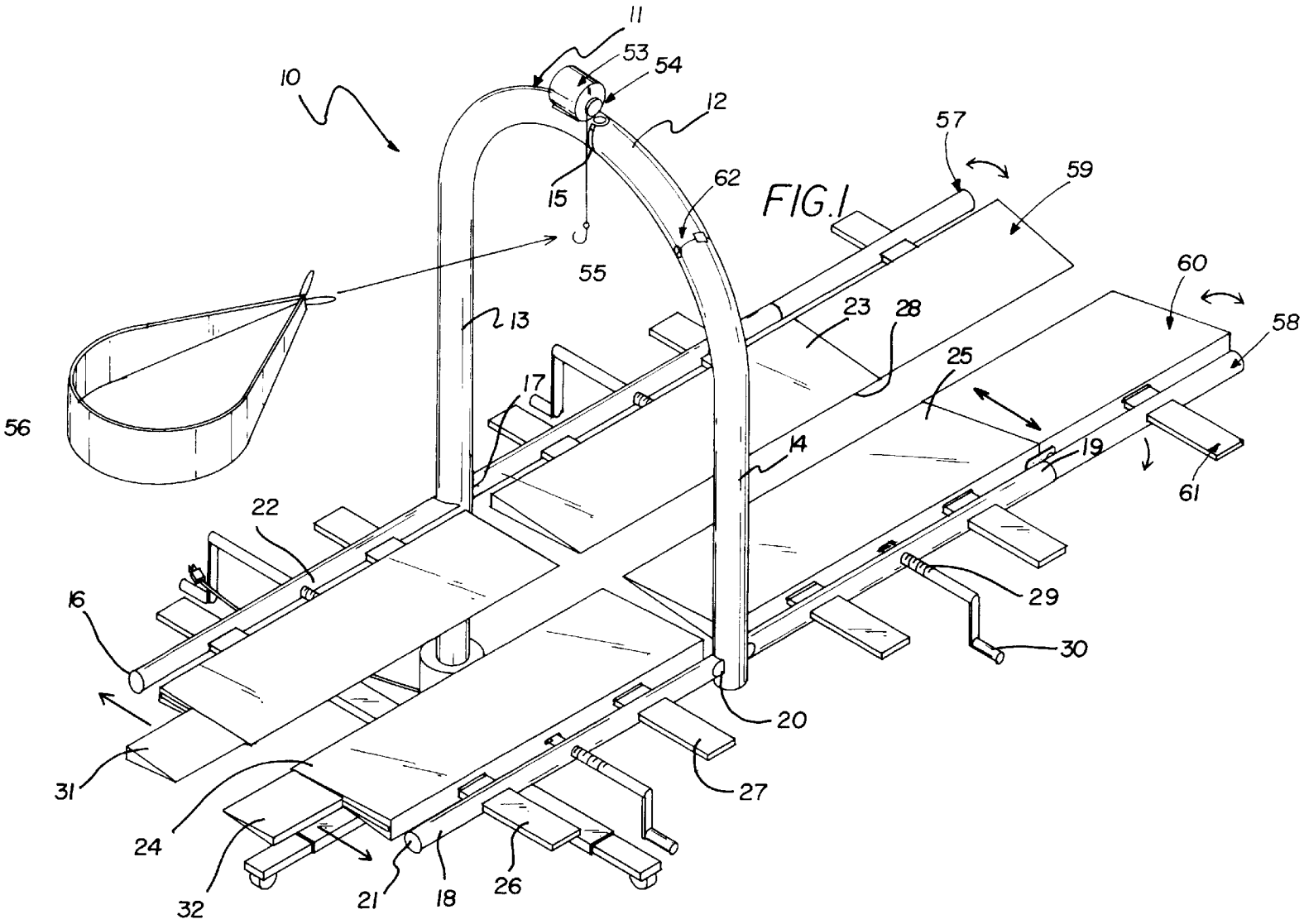
FIG. 1 is a schematic perspective view of a new gurney-wheelchair with the side bars in their lowered positions according to the present invention.

With reference now to the drawings, and in particular to FIGS. 1 through 4 thereof, a new gurney-wheelchair embodying the principles and concepts of the present invention and generally designated by the reference numeral 10 will be described.

As best illustrated in FIGS. 1 through 4, the gurney-wheelchair 10 generally comprises a generally inverted U-shaped cross bar 11 with an upper portion 12, a hoist system 53,54,55,56, and a spaced apart pair of arm portions 13,14 downwardly depending from the upper portion of the cross bar. Each of the arm portions of the cross bar has a pair of opposite elongate side bars 16,17,18,19 outwardly extending therefrom. The inner ends 20 of the side bars are pivotally coupled to the associated arm portion of the cross bar. The side bars 16,17,57 of a first of the arm portions 13 each have a support wedge 22,23 59 pivotally mounted thereto and capable of folding upwards vertically. The side bars 18,19,58 of a second of the arm portions 14 each have a support wedge 24,25,60 pivotally mounted thereto and capable of folding upwards, vertically. Each of the support wedges 22,23,24,25 of the first and second arm portion has a pair of mounting arms 26,27 slidably extended through the associated side bar of the first and second arm portions. Support wedges 59,60 each have one mounting arm 61. The lower end of the first arm portion 13 is coupled to a ground engaging base structure.

In closer detail, the gurney-wheelchair 10 comprises a generally inverted U-shaped cross bar 11 having an arcuate upper portion 12 and a spaced apart pair of generally straight elongate arm portions 13,14 downwardly depending from the upper portion of the cross bar. The cross bar preferably has a generally circular transverse cross section and has a hoist system portioned on top. Each of the arm portions 13,14 of the cross bar has a longitudinal axis and terminates at a lower end. The longitudinal axes of the arm portions are extended generally vertically such that the cross bar lies in a generally vertical plane. Each of the arm portions has a length defined between the upper portion of the cross bar and the lower end of the respective arm portion. Preferably, the length of the first arm portion 13 is greater than the length of the second arm portion 14.

Preferably, as illustrated in FIG. 1, between the upper portion 12 of the cross bar and the second arm portion 14, is a break 62 with a pivot coupling allowing arm 14 to be pivoted laterally outwards so as to accommodate larger patients.

Figure 2:
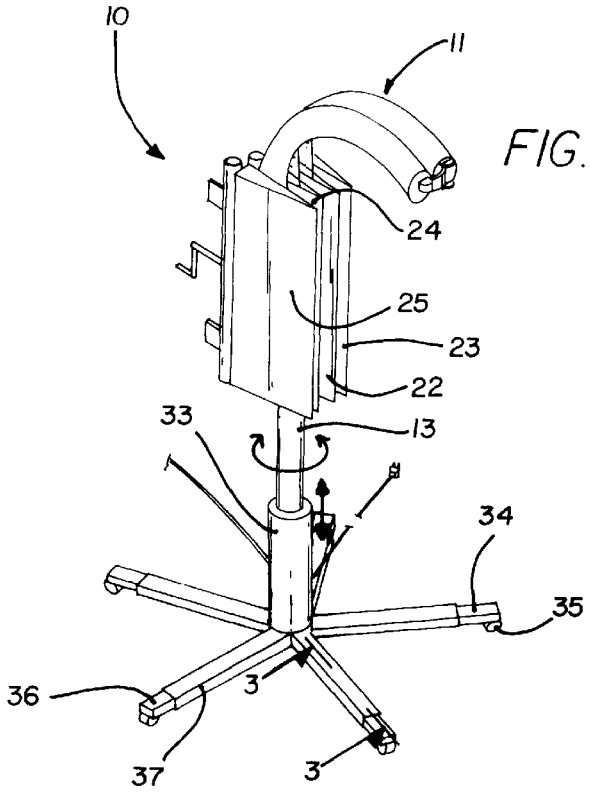
FIG. 2 is a schematic perspective view of the present invention with the side bars in their raised position and the cross bar pivoted to a folded position.

Preferably, as illustrated in FIGS. 1 and 2, the upper portion 12 of the cross bar has a break 15 therethrough located at a midpoint between the arm portions of the cross portion. The break of the upper portion of the cross bar divides the cross bar into a pair of generally J-shaped portions. The J-shaped portions of the cross bar are pivotally coupled together at the break of the upper portion of the cross bar so that the cross bar may be pivoted between a deployed position as illustrated in FIG. 1 for use of the gurney-wheelchair and a folded position as illustrated in FIG. 2 for compacting of the gurney-wheelchair when not in use for convenient storage.

Each of the arm portions of the cross bar has a pair of opposite elongate side bars 16,17,18,19 57 58, outwardly extending therefrom. Each of the side bars has opposite inner and outer ends 20,21, and a longitudinal axis extending between the inner and outer ends of the respective side bar. Preferably, each of the side bars has a generally circular transverse cross section substantially perpendicular to the longitudinal axis of the respective side bar. The inner ends 20 of the side bars are pivotally coupled to the associated arm portion of the cross bar. The outer end of sidebars 17,19 are pivotally coupled to side bars 57,58 which can be lowered to a vertical position or raised to a horizontal position. Each of the side bars is pivotable between a lowered position (FIG. 1) and a raised position (FIG. 2). As illustrated in FIG. 1, the longitudinal axes of the side bars 16,17,18,19 are extended generally horizontally when the side bars are positioned in the lowered position and the side bars 57,58 are in the raised position. Preferably, the longitudinal axes of the side bars generally lie in a common horizontal plane when the side bars are in the lowered position 16,17,18,19 and the side bars 57,58 are in their raised position. As illustrated in FIG. 2, the longitudinal axes of the side bars are extended generally vertically when the side bars are positioned in the raised position. In a preferred embodiment, the longitudinal axes of the side bars 16,17 of the first arm portion 13 of the cross bar are generally collinear when the side bars of the first arm portion are positioned in the lowered position. Similarly, the longitudinal axes of the side bars 18,19 of the second arm portion 14 of the cross bar are preferably generally collinear when the side bars of the second arm portion are positioned in the lowered position.

The side bars 16,17,57 of the first arm portion each have a padded support wedge 22,23,59 mounted thereto. Similarly, the side bars 18,19,58 of the second arm portion each have a padded support wedge 24,25,60 mounted thereto. Each of the support wedges 24,25 of the second arm portion has a pair of mounting arms 26,27 slidably extended through the associated side bar 18,19 of the second arm portion. The support wedge 60 of the second portion has one mounting arm slidably extended through the associated side bar 58. Each of the support wedges of the first arm portion is paired with an associated support wedge of the second arm portion. Each of the support wedges preferably has a generally triangular transverse cross section taken generally perpendicular to the longitudinal axis of the associated side bar. In this preferred embodiment, each of the side wedges tapers to an inner vertex edge 28. The inner vertex edges of each associated pair of support wedges face one another. The inner vertex edges of each associated pair of support wedges are preferably extended generally parallel to one another with the respective side bars are positioned in the lowered position.

The support wedges of 22,23,24,25 59 and 60 the first and second arm portions are slidably positionable towards one another. Each of the support wedges of the first and second arm portions preferably has a threaded rod 29 rotatably coupled thereto and threadably extended through the adjacent respective side bar 16,17,18,19 of the second portion such that the threaded rods outwardly extend from the side bars of the first and second arm portions away from the support wedges of the second arm portion. Each of the threaded rods has an outer end handle 30 adapted for aiding the rotating of threaded rods through side bars of the second arm portion. In use, rotating each of the threaded rods in a first direction advances the threaded rods to move the side wedges of the second arm portion away from the side bars of the second arm portion and towards the side wedges of the first arm portion. Conversely, rotating each of the threaded rods in a second direction advances the threaded rods to move the side wedges of the second arm portion towards the side bars of the second arm portion and away from the side wedges of the first arm portion. Optionally, rotation of the threaded rods may be performed by a motor connected to the threaded rods instead of manual rotation.

Ideally, one pair of associated side wedges 22,24 of the first and second arm portions each have a padded head wedge 31,32 outwardly extending therefrom. Each of the head wedges is slidably mounted to the respective side wedge to permit sliding of the head wedges towards and away from one another.

The support wedges 59,60 are pivotally linked to support wedges 23,25. This link can easily be unhooked making support wedges 23,25,60,59 capable of folding upwards vertically even while the patient is in a sitting position.

In use, the side wedges are designed for inserting between a bed structure and a patient lying on the bed structure. As the side wedges of the first and second arm portions are moved together by the threaded rods, the side wedges form a surface for resting the patient on so that the patient can be moved from the bed structure. The head wedges may then be moved together to let the head of the patient rest on them. To place a patient resting on the side wedges on to a bed structure, the side wedges are positioned over the bed structure and the side wedges and head wedges are then spread apart so that the patient is laid on the bed structure and the gurney-wheelchair can be moved away from the bed structure. The triangular cross section of the side wedges help aid the sliding of the side wedges between the patient and the bed structure. Furthermore, to facilitate the transfer to and from a bed structure or chair, the patient can be attached by means of a harness 56 or sling to a hoist system (comprising a hoist 53, a pulley 54, and a hook 55) for aiding in further raising or lowering of the patient as desired.

Preferably, the lower end of the first arm portion 13 has a fluidic piston-cylinder actuator 33 coupled thereto to permit selective raising and lowering of the cross bar with respect to a ground surface. The lower end of the first arm portion is rotatably mounted to the fluidic piston-cylinder actuator to permit free rotation of the first arm portion about the longitudinal axis of the first arm portion so that the side wedges may be rotated in a horizontal plane when in the lowered position. The fluidic piston-cylinder actuator is coupled to a ground engaging base structure. In use, the fluidic piston-cylinder actuator is designed for permitting the raising and lowering of the side wedges in the lowered position with respect to the ground surface to fit various heights of bed structures or chairs.

Figure 3:
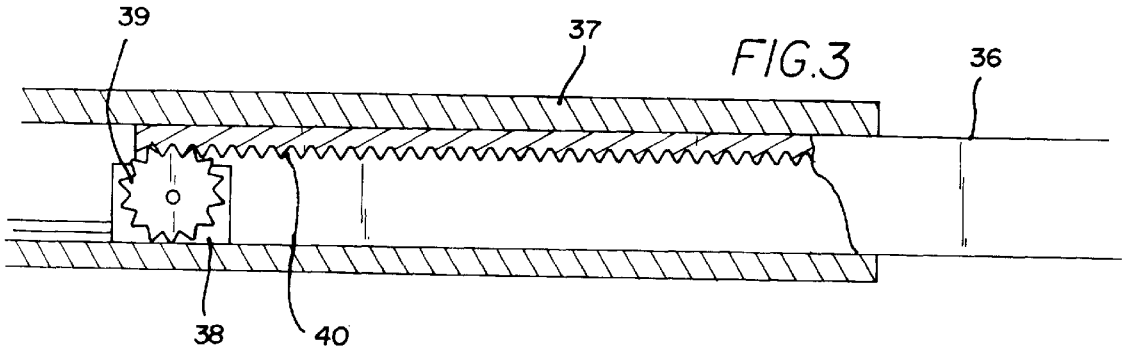
FIG. 3 is a schematic cross sectional view of a support leg taken from line 3—3 of FIG. 2.

With reference to FIG. 2, in a first preferred embodiment, the base structure comprises a plurality of support legs 34 outwardly radiating from the fluidic piston-cylinder actuator of the lower end of the first arm portion. Ideally, the plurality of support legs comprises five support legs each defining an angle of about 72 degrees with each adjacent support leg. Each of the support legs has a free end with a ground engaging wheel 35 coupled thereto to permit rolling of the base structure on the ground surface. Preferably, each of the support legs is telescopically extendable. In this preferred embodiment, each of the support legs has a pair of telescopic portions 36,37. A first of the telescopic portions 36 of each of the support legs is telescopically inserted into a second of the telescopic portions 37 of the respective support leg. With reference to FIG. 3, ideally, the second telescopic portion 37 of each of the support legs has a motor 38 provided therein which rotates a gear 39 rotatably mounted thereto. The gear of each of the support legs engages a longitudinally extending row of teeth 40 on the first telescopic portion of the respective support leg to permit telescopic extension and retraction of the first telescopic portion with respect to the second telescopic portion. Preferably, the motor of each support leg is connected to a controller to permit a user to selectively rotate the gear to telescopically extend and retract the respective support leg.

Figure 4:
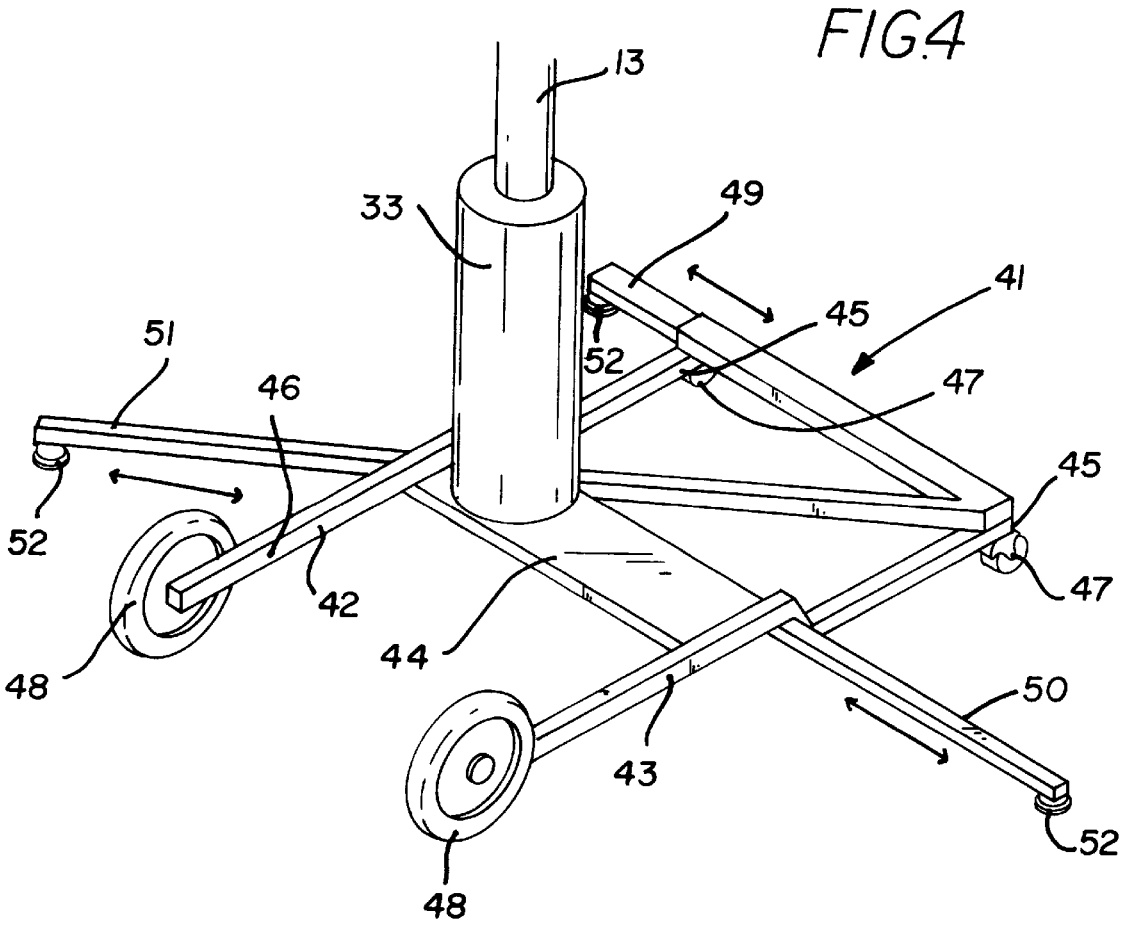
FIG. 4 is a schematic perspective view of another preferred embodiment of the base structure.

With reference to FIG. 4, in another preferred embodiment, the base structure has a generally H-shaped frame 41 comprising a spaced apart pair of generally parallel side members 42,43 and a cross member 44 connecting the side members together. The fluidic piston-cylinder actuator 33 of the lower end of the first arm portion is coupled to the cross member adjacent one of the side members of the frame. Each of the side members has first and second ends 45,46 each having a ground engaging wheel 47,48 rotatably mounted thereto. Ideally, the wheels 48 of the second ends of the side frames each have a diameter greater than a diameter of each of the wheel 47 of the first ends of the side frames.

The base structure has telescopic first, second, and third support bars 49,50,51 each terminating at a free end. The free end of each of the support bars has a ground engaging foot pad 52 coupled thereto for aiding stabilizing of the base structure on the ground surface. The first support bar 49 is coupled to the first ends of the side members of the frame and extends generally perpendicular to the side members of the frame. The free end of the first support bar is outwardly extended from a first of the side members 42. The second support bar 50 is coupled to the side members of the frame adjacent the cross member of the frame and extends generally perpendicular to the side members of the frame and generally parallel to the first support bar. The free end of the second support bar is outwardly extended from a second of the side members 43. The third support bar 51 is coupled to the first end of the second side member and the second end of the first side member such that the third support bar is extended diagonally to the first and second support bars. The free end of the third support bar is outwardly extended diagonally from the second end of the first side member 42.

Preferably, each of the support bars 49,50,51 is telescopically extendable. Ideally, each of the support bars is constructed similar to the support legs of the other preferred embodiment illustrated in FIG. 3, with a pair of telescopic portions. A first of the telescopic portions of each of the support bars is telescopically inserted into a second of the telescopic portions of the respective support bar. The second telescopic portion of each of the support bars has a motor provided therein which rotates a gear rotatably mounted thereto. The gear of each of the support bars engages a longitudinally extending row of teeth on the first telescopic portion of the respective support bar to permit telescopic extension and retraction of the first telescopic portion with respect to the second telescopic portion. Preferably, the motor of each support bar is connected to a controller to permit a user to selectively rotate the gear to telescopically extend and retract the respective support bar.

In use, the support bars are designed for providing additional stability when the first arm portion is rotated about its longitudinal axis so that when the side wedges are not positioned directly over the base structure, the gurney-wheelchair does not tip over.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gurney-wheelchair, comprising:

a generally inverted U-shaped cross bar having an upper portion and a spaced apart pair of arm portions downwardly depending from said upper portion of said cross bar;

each of said arm portions of said cross bar having a longitudinal axis and terminating at a lower end;

each of said arm portions of said cross bar having a pair of opposite elongate side bars outwardly extending therefrom, each of said side bars having opposite inner and outer ends, and a longitudinal axis extending between said inner and outer ends of the respective side bar;

said inner ends of said side bars being pivotally coupled to the associated arm portion of said cross bar each of said side bars being pivotable between a lowered position and a raised position;

said side bars of a first of said arm portions each having a support wedge pivotally mounted thereto, each of said support wedges of said first arm portion having a pair of mounting arms slidably extended through the associated side bar of said first arm portion;

said side bars of a second of said arm portions each having a support wedge pivotally mounted thereto, each of said support wedges of said second arm portion having a pair of mounting arms slidably extended through the associated side bar of said second arm portion;

each of said support wedges of said first arm portion being paired with an associated support wedge of said second arm portion said associated support wedges of said first and second arm portions being slidably positionable towards and away from one another; and said lower end of said first arm portion being coupled to a ground engaging base structure.

2. The gurney-wheelchair of claim 1, wherein each of said arm portions having a length defined between said upper portion of said cross bar and the lower end of the respective arm portion, wherein said length of said first arm portion is greater than said length of said second arm portion.

3. The gurney-wheelchair of claim 1, wherein said upper portion of said cross bar has a break therethrough located at a midpoint between said arm portions of said cross portion, said break of said upper portion of said cross bar dividing said cross bar into a pair of generally J-shaped portions, said J-shaped portions of said cross bar being pivotally coupled together at said break of said upper portion of said cross bar.

4. The gurney-wheelchair of claim 1, wherein said longitudinal axes of said side bars are extended generally horizontally when said side bars are positioned in said lowered position, said longitudinal axes of said side bars generally lying in a common horizontal plane when said side bars are in said lowered position, and wherein said longitudinal axes of said side bars are extended generally vertically when said side bars are positioned in said raised position.

5. The gurney-wheelchair of claim 4, wherein said longitudinal axes of said side bars of said first arm portion of said cross bar are generally collinear when said side bars of said first arm portion are positioned in said lowered position, said longitudinal axes of said side bars of said second arm portion of said cross bar being generally collinear when said side bars of said second arm portion are positioned in said lowered position.

6. The gurney-wheelchair of claim 1, wherein each of said support wedges has a generally triangular transverse cross section taken generally perpendicular to said longitudinal axis of the associated side bar, each of said side wedges tapering to an inner vertex edge, said inner vertex edges of each associated pair of support wedges facing one another.

7. The gurney-wheelchair of claim 6, wherein said inner vertex edges of each associated pair of support wedges are extended generally parallel to one another with the respective side bars are positioned in the lowered position.

8. The gurney-wheelchair of claim 1, wherein said lower end of said first arm portion has a fluidic piston-cylinder actuator coupled thereto to permit selective raising and lowering of said cross bar with respect to a ground surface.

9. The gurney-wheelchair of claim 8, wherein said lower end of said first arm portion is rotatably mounted to said fluidic piston-cylinder actuator to permit free rotation of said first arm portion about said longitudinal axis of said first arm portion.

10. The gurney-wheelchair of claim 8, wherein said fluidic piston-cylinder actuator being coupled to said ground engaging base structure.

11. The gurney-wheelchair of claim 1, wherein said base structure comprises a plurality of support legs outwardly radiating from said lower end of said first arm portion.

12. The gurney-wheelchair of claim 11, wherein each of said support legs has a free end, said free end of each of said support legs having a ground engaging wheel coupled thereto to permit rolling of said base structure on the ground surface.

13. The gurney-wheelchair of claim 12, wherein each of said support legs is telescopically extendable, wherein each of said support legs has a pair of telescopic portions, a first of said telescopic portions of each of said support legs being telescopically inserted into a second of said telescopic portions of the respective support leg.

14. The gurney-wheelchair of claim 13, wherein said second telescopic portion of each of said support legs has a motor provided therein, each of said motors rotating a gear rotatably mounted thereto, said gear of each of said support legs engaging a longitudinally extending row of teeth on said first telescopic portion of the respective support leg to permit telescopic extension and retraction of said first telescopic portion with respect to said second telescopic portion, said motor of each support leg being connected to a controller to permit a user to selectively rotate the gear to telescopically extend and retract the respective support leg.

15. A gurney-wheelchair, comprising:

a generally inverted U-shaped cross bar having an arcuate upper portion and a spaced apart pair of generally straight elongate arm portions downwardly depending from said upper portion of said cross bar, said cross bar having a generally circular transverse cross section;

each of said arm portions of said cross bar having a longitudinal axis and terminating at a lower end, said longitudinal axes of said arm portions being extended generally vertically such that said cross bar lies in a generally vertical plane;

each of said arm portions having a length defined between said upper portion of said cross bar and the lower end of the respective arm portion, wherein said length of a first of said arm portions is greater than said length of a second of said arm portions;

said upper portion of said cross bar having a break therethrough located at a midpoint between said arm portions of said cross portion, said break of said upper portion of said cross bar dividing said cross bar into a pair of generally J-shaped portions, said J-shaped portions of said cross bar being pivotally coupled together at said break of said upper portion of said cross bar;

each of said arm portions of said cross bar having a pair of opposite elongate side bars outwardly extending therefrom, each of said side bars having opposite inner and outer ends, and a longitudinal axis extending between said inner and outer ends of the respective side bar, each of said side bars having a generally circular transverse cross section substantially perpendicular to said longitudinal axis of the respective side bar;

said inner ends of said side bars being pivotally coupled to the associated arm portion of said cross bar, each of said side bars being pivotable between a lowered position and a raised position;

said longitudinal axes of said side bars being extended generally horizontally when said side bars are positioned in said lowered position, said longitudinal axes of said side bars generally lying in a common horizontal plane when said side bars are in said lowered position;

said longitudinal axes of said side bars being extended generally vertically when said side bars are positioned in said raised position;

said longitudinal axes of said side bars of said first arm portion of said cross bar being generally collinear when said side bars of said first arm portion are positioned in said lowered position, said longitudinal axes of said side bars of said second arm portion of said cross bar being generally collinear when said side bars of said second arm portion are positioned in said lowered position;

said side bars of said first arm portion each having a support wedge pivotally mounted thereto, each of said support wedges of said first arm portion having a pair of mounting arms slidably extended through the associated side bar of said first arm portion;

said side bars of said second arm portion each having a support wedge pivotally mounted thereto, each of said support wedges of said second arm portion having a pair of mounting arms slidably extended through the associated side bar of said second arm portion;

each of said support wedges of said first arm portion being paired with an associated support wedge of said second arm portion each of said support wedges having a generally triangular transverse cross section taken generally perpendicular to said longitudinal axis of the associated side bar, each of said side wedges tapering to an inner vertex edge, said inner vertex edges of each associated pair of support wedges facing one another;

said inner vertex edges of each associated pair of support wedges being extended generally parallel to one another with the respective side bars are positioned in the lowered position;

each associated pair of support wedges of said first and second arm portions being slidably positionable towards and away from one another;

each of said support wedges of said second arm portion having a threaded rod rotatably coupled thereto and threadably extended through the adjacent respective side bar of said second portion such that said threaded rods outwardly extend from said side bars of said second arm portion away from said support wedges of said second arm portion;

each of said threaded rods having an outer end handle adapted for aiding the rotating of threaded rods through side bars of said second arm portion;

wherein rotating each of said threaded rods in a first direction advances said threaded rods to move said side wedges of said second arm portion away from said side bars of said second arm portion and towards said side wedges of said first arm portion;

wherein rotating each of said threaded rods in a second direction advances said threaded rods to move said side wedges of said second arm portion towards said side bars of said second arm portion and away from said side wedges of said first arm portion;

wherein one pair of associated side wedges of said first and second arm portions each having a head wedge outwardly extending therefrom, each of said head wedges being slidably mounted to the respective side wedge to permit sliding of said head wedges towards and away from one another;

said lower end of said first arm portion having a fluidic piston-cylinder actuator coupled thereto to permit selective raising and lowering of said cross bar with respect to a ground surface;

said lower end of said first arm portion being rotatably mounted to said fluidic piston-cylinder actuator to permit free rotation of said first arm portion about said longitudinal axis of said first arm portion;

said fluidic piston-cylinder actuator being coupled to a ground engaging base structure;

said base structure having a generally H-shaped frame comprising a spaced apart pair of generally parallel side members and a cross member connecting said side members together, said fluidic piston-cylinder actuator of said lower end of said first arm portion being coupled to said cross member adjacent one of said side members of said frame;

each of said side members having first and second ends each having a ground engaging wheel rotatably mounted thereto, wherein said wheels of said second ends of said side frames each have a diameter greater than a diameter of each of said wheel of said first ends of said side frames;

said base structure having telescopic first, second, and third support bars each terminating at a free end, said free end of each of said support bars having a ground engaging foot pad coupled thereto;

said first support bar being coupled to said first ends of said side members of said frame, said first support bar being extended generally perpendicular to said side members of said frame, said free end of said first support bar being outwardly extended from a first of said side members;

said second support bar being coupled to said side members of said frame adjacent said cross member of said frame, said second support bar being extended generally perpendicular to said side members of said frame and generally parallel to said first support bar, said free end of said second support bar being outwardly extended from a second of said side members;

said third support bar being coupled to said first end of said second side member and said second end of said first side member such that said third support bar is extended diagonally to said first and second support bars, said free end of said third support bar being outwardly extended from said second end of said first side member;

each of said support bars being telescopically extendable, wherein each of said support bars has a pair of telescopic portions, a first of said telescopic portions of each of said support bars being telescopically inserted into a second of said telescopic portions of the respective support bar; and said second telescopic portion of each of said support bars having a motor provided therein, each of said motors rotating a gear rotatably mounted thereto, said gear of each of said support bars engaging a longitudinally extending row of teeth on said first telescopic portion of the respective support bar to permit telescopic extension and retraction of said first telescopic portion with respect to said second telescopic portion, said motor of each support bar being connected to a controller to permit a user to selectively rotate the gear to telescopically extend and retract the respective support bar.

* * * * *